United States Patent [19]

Jenkins et al.

[11] 4,146,933

[45] Apr. 3, 1979

[54] CONDITIONED-AIR SUIT AND SYSTEM

[75] Inventors: Barry R. Jenkins, Box 160, Circleville, Utah 84723; Waldo C. Roberts, Salt Lake City, Utah; Frank W. Roberts, Midvale, Utah

[73] Assignee: Barry R. Jenkins, Circleville, Utah

[21] Appl. No.: 706,764

[22] Filed: Jul. 19, 1976

[51] Int. Cl.[2] ..... A41D 13/00

[52] U.S. Cl. ..... 2/2; 2/DIG. 1; 2/79; 2/108; 2/2.1 A

[58] Field of Search ..... 2/2, 2.1 A, 81, 78 R, 2/93, 108, DIG. 1, 16, 22, 79; 165/46; 128/402; 62/259

[56] References Cited

U.S. PATENT DOCUMENTS

| | | | |
|---|---|---|---|
| 825,851 | 7/1906 | MacKaskie | 2/DIG. 1 |
| 2,093,834 | 9/1937 | Gaugler | 128/402 UX |
| 2,255,751 | 9/1941 | Bancel | 128/402 X |
| 2,573,414 | 10/1951 | Dunn | 2/81 X |
| 2,657,396 | 11/1953 | Klein et al. | 2/81 UX |
| 3,292,179 | 12/1966 | Iacono, Jr. et al. | 2/2 R |
| 3,537,108 | 11/1970 | Daniels | 2/DIG. 6 |
| 3,710,395 | 1/1973 | Spano et al. | 2/81 X |
| 3,969,772 | 7/1976 | Pravaz | 2/79 |

FOREIGN PATENT DOCUMENTS

| | | | |
|---|---|---|---|
| 1155985 | 12/1957 | France | 2/DIG. 1 |
| 564877 | 12/1956 | Italy | 2/108 |
| 794266 | 4/1958 | United Kingdom | 2/81 |
| 126020 | 4/1959 | U.S.S.R. | 2/81 |

*Primary Examiner*—Peter Nerbun
*Attorney, Agent, or Firm*—M. Ralph Shaffer

[57] ABSTRACT

A conditioned-air suit and system wherein a user may have his person made more comfortable during excessively warm or cold environmental conditions. The suit or jacket or coat, as the case may be, is provided with air-conditioning hose connections at both front and left sides and also at the rear of the apparel, for purposes hereinafter enumerated. A hood is provided such that forced conditioned air will be effective to cause a separation between hood materials so as to provide a blanket of conditioned air between the head of the wearer and exterior environs. Knee and shoulder areas are constructed to provide for vertical air travel paths about the joint areas. Wrist and ankle areas can be provided with elastomeric cuffs, as desired. The system herein comprehends inclusion of an air-conditioned suit with a source of heated, cooled, or otherwise conditioned air from a variety of sources, and this for a variety of uses and functions as hereinafter pointed out.

4 Claims, 11 Drawing Figures

CONDITIONED-AIR SUIT AND SYSTEM

FIELD OF INVENTION

The present invention related to air-conditioned wearing apparel and, more particularly, to an improved article of apparel intended for attachment to an air-condition hose at one of multiple locations, to provide conditioned-air interior of the garment and also the proximate head area where a hood is employed. The system comprehends both vehicle usage and also usage by hunters, fishermen and other outdoorsmen, for example, at inclement and/or cold weather areas.

DESCRIPTION OF PRIOR ART

Certain U.S. patents have issued and relate to the general subject area of air-conditioned protectors and apparels, as follows:

U.S. Pat. Nos. 586,998; 2,255,751; 2,413,386; 3,307,554; 3,610,251.

U.S. Pat. No. 586,998, an early patent, teaches the provision of a fuel cartridge that is actually ignited and carried by the coat of the wearer.

U.S. Pat. No. 2,255,751 teaches a ventilated suit employing a certain belt connection, but without the several features which are described in the present invention and which are highly advantageous.

U.S. Pat. No. 2,413,386 teaches an air-conditioned jacket, but not having the essential plurality of the connections as taught in the invention or other features which are inherently desirable.

U.S. Pat. No. 3,610,251 teaches solely a hair dryer type of implement which is secured to a loose-fitting body enclosure as would be suitable for infants.

BRIEF DESCRIPTION OF THE INVENTION

The present invention includes the provision of an air-conditioned suit or jacket having, first of all, three air-conditioning hose attachment ports provided with cloth-like adhesion means. Each of the ports is provided with a flap that is closed over the port when the same is not in use. An air-conditioning hose or conduit is selectively coupled to one of the three ports, mainly, to the rear port when the user is on an assembly line, for example, or to the right or left front port when the employer is operating a tractor, a backhoe, is disposed on a snowmobile, etc. Clearly, for universality both right and left-forward connections and also the rear connection are necessary.

The subject suit or jacket preferably contains a hood which has a loose inner lining providing an air passage way or cushion between such inner liner and the outer portion of the hood. This is to insulate the head from external harsh ambient conditions.

Knee and elbow areas are preferably provided with material delineating vertical air passage ways or channels intended for circulation of air even though the limbs of the user are bent from time to time.

Cloth-like adhesive means such as that going under the trade name Velcro are employed for securement of the air-conditioning hose to the jacket or suit proximate port areas, and also flaps.

In the subject system of the invention provision is made for heating incoming air to the suit by means of engine heat proximate the exhaust manifold of the engine of a tractor or backhoe, for example, by heat exchange with the oil or water system of a vehicle, or by a ground unit which outdoorsmen may use from time to time.

OBJECTS

Accordingly, a principal object of the present invention is to provide a new and improved air-conditioned unit of apparel such as this suit or jacket or coat, for example, with desirable hose attachment means.

A further object is to provide air-conditioned wearing apparel having forward-right and left and also rear attachment ports for convenient and desirable connection to an air-conditioning hose conduit.

A further object is to provide a piece of wearing apparel wherein a hood is provided, the same including an air space between the inner layer of the hood and the outer layer thereof.

A further object is to provide a suit and heating unit combination for outdoor use such as by fishermen, hunters in duck blinds, et cetera.

An additional object is to provide a suit and conditioned-air intake means appropriate for an air-conditioning system, for connection to or past a warm air source such as an engine exhaust manifold, heater, or hot-water, air or oil system, et cetera.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF DRAWINGS

In FIG. 1 a suit 10 may have a zippered front at 11 and a hood 12. Most important, the suit does not have inner and outer layers with air being conducted therebetween, but rather may comprise a simple quilted, rayon, plastic or other type of suit material having essentially a single layer surrounding the body. It is to be understood that in the invention herein conditioned air is blown between the garment or suit 10 and the user's inner clothing. The body 10B of suit 10 includes right side, left side, and rear openings or wall ports 13–15 which serve as conditioned air passageways. Each of these openings is provided with a circumferential cloth-like adhering ring 16 fabricated from material known to the trade, for example, as Velcro. Flaps 17–19 are sewn at their respective upper margins 20A to the garment or suit 10 and preferably will include a corresponding cloth adhesive ring 21, made also of Velcro. In the art Velcro material includes one type of material having a series of hooks and another type of material having a series of loops and that when these materials are mutually pressed together the hooks will catch in the loops and tend to retain the two material pieces in intimate contact.

Figure 1:
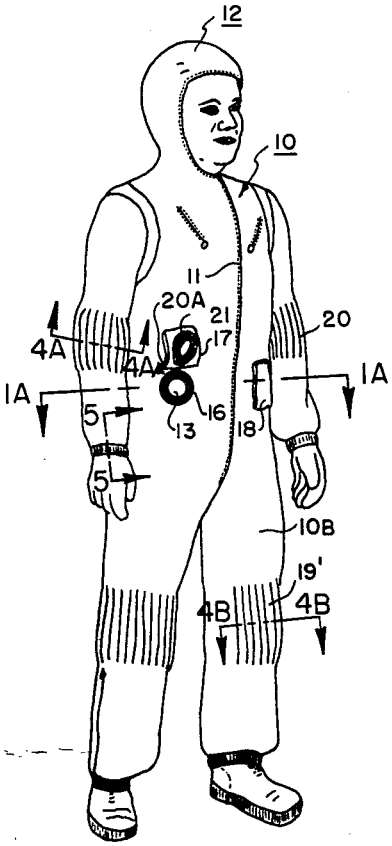
FIG. 1 is a perspective view of a person wearing an air-conditioned suit constructed in accordance with the principles of the present invention.

In the suit herein, the Velcro strip 21 will engage the Velcro ring 16 as the flap 17 is closed, thereby closing a particular port.

It is essential, in a preferred embodiment of the invention, that all three ports appear. The rear or back port or hole at 15 is for securing air-conditioning or heating hose to the rear of the wearer so that his arm areas may be completely free of obstructions. In certain instances, as in the case of backhoe usage, the driver of the vehicle wearing the suit 10 will wish to connect the hose either to one side or to the other, i.e. at either 13 or 14 in FIG. 1A. For persons intending a run on a snowmobile, the right or left port 13, 14 will be connected, depending upon whether the user is sitting on the right or left and considering exactly how and in what condition or position the air-conducting hose is attached or extends from the vehicle.

Figure 4A:
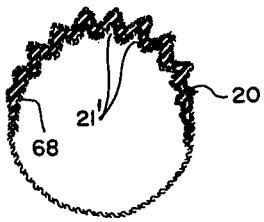
FIG. 4A is an enlarged horizontal section looking upwardly and taken along the line 4A—4A in FIG. 1, illustrating corrugated elbow areas of the suit.
Figure 4B:
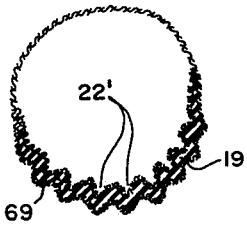
FIG. 4B is similar to FIG. 4A but is taken along the line 4B—4B in FIG. 1, illustrating in section the knee areas of the suit.

In order to accommodate air circulation past knee and elbow areas, even at times when the knees and elbows are bent, vertically corrugated knee segments at 19' in FIG. 4B and vertically corrugated arm segments at 20 in FIG. 4A may be utilized. The construction here may take any one of several forms and is merely for the purpose of slightly stiffening the garment material proximate the knees and elbows so that vertical, air-conducting spaces at 21' and at 22' are presented. Such can be supplied when an outer segment is used and the outer and inner segments are simply stitched in a manner such that the inner material convolutes to provide the air passageways 21 and 22. Alternatively, a corrugated stiffener liner 68 may be employed inwardly of the garment and this liner stitched to the outer material of the garment 10, so as to provide successive passageways 21 and 22 to allow for air passage across the elbow and knee areas. Likewise, simply a single layer of padded material 69 can be employed, with stitching being made so that slight air spaces, or inwardly unobstructed, air-passageway corrugations at 21' and 22' exist. What is the essence of this portion of the invention is the provision of knee and elbow areas which offer vertical, progressively-spaced internal air passageways 21 and 22 so that air will flow past the elbow and knee areas even though the legs and arms may be bent either slightly or prominently.

Figure 2:
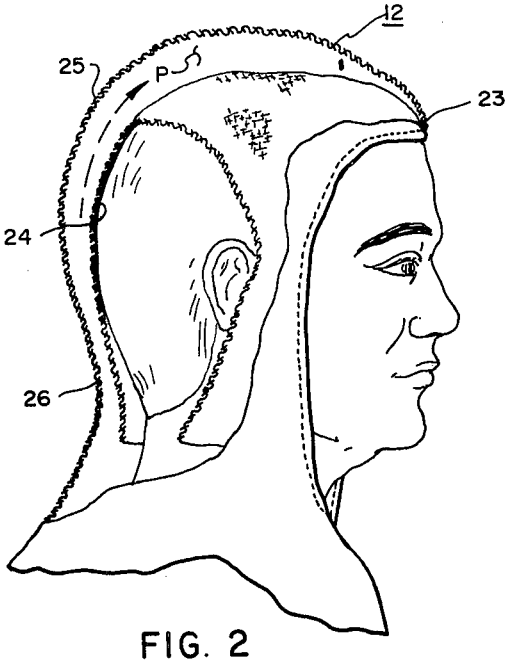
FIG. 2 is an enlarged, fragmentary elevation of the hood portion of the suit in FIG. 1, and is partially broken away for purposes of clarity.

In FIG. 2 the hood 12 is shown to have a hood portion 25 stitched at 23 to inner head liner 24 that is open relative to the hood outer portion 25. Accordingly, space 26 will exist to provide for a forced air path P to heat or otherwise air-condition this area, i.e. between liner 24 and hood portion 25. Thus, air forced upwardly will tend to proceed along path P to separate cover 24 from hood 25 and provide a warm air or other region at P for protecting the head area.

Figure 1A:
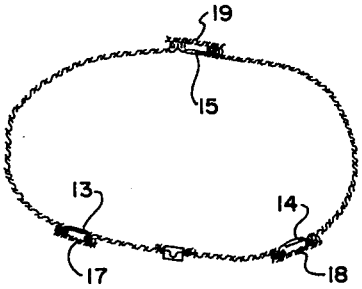
FIG. 1A is an enlarged horizontal section looking downwardly and taken along line 1A—1A in FIG. 1.
Figure 3:
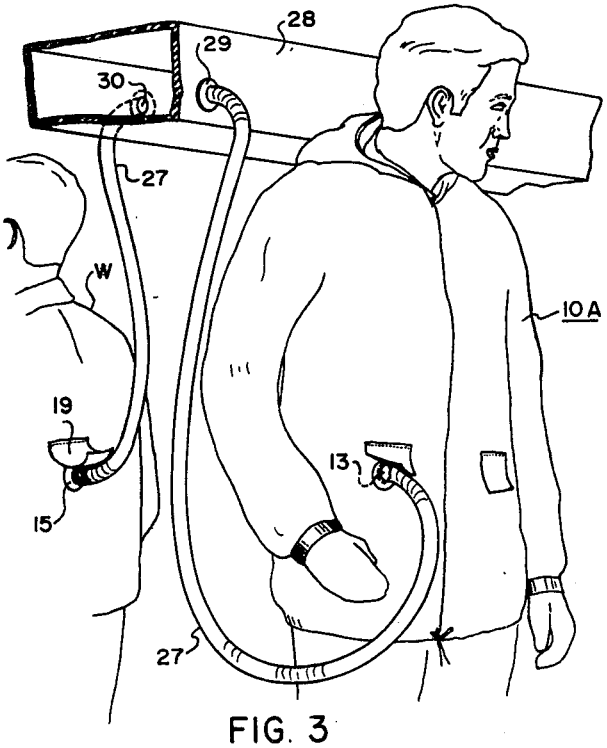
FIG. 3 is a perspective view showing a pair of workmen having their jackets coupled to a heating or air-conditioning system in a factory, for example.

It will be understood that the invention comprehends both the long suits shown at 10 in FIG. 1 and also the jacket forms for workmen as illustrated in FIG. 3 by jacket 10A. The structure will otherwise be the same. FIG. 3 illustrates that air conduit 27 may be secured to a front port 13, see in correspondence FIGS. 1 and 1A, or, referring to a second workman at W in FIG. 3, the air conduit 27 can be connected to the back or rear aperture 15. In any case, duct work 28 will be provided with suitable fittings 29 and 30 to accommodate hose installation. Mating Velcro fasteners, as in FIG. 1, may be employed, and conventional flange connections, as used in the case of vacuum cleaners, provided. It is to be noted that the duct work 28 may contain either warmed air for winter-time use, conditioned air for year-round use, or even cooler air as in air-conditioning as in summer-time employment. In the case of the workman W whose back is seen in FIG. 3, the jacket can be employed in the manner such as to render the lower arm areas completely unobstructed.

Figure 5:
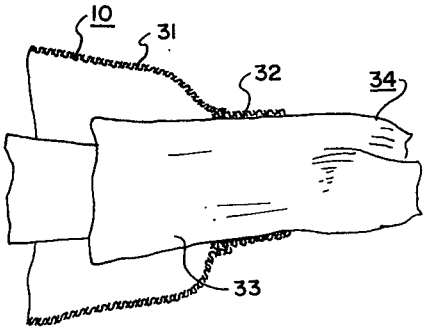
FIG. 5 is a fragmentary enlarged detail, illustrating the manner in which the cuff area of the jacket or suit in FIGS. 3 and 1, respectively, may encompass the wrist portion of the glove of the user.

In FIG. 5 the sleeve 31 of garment 10 is shown to include a cuff 32 that loops about the rear elongated portion 33 of glove 34. As air pressure builds up inside this suit, owing to the introduction of air into one of the ports 13–15, air will proceed downwardly to the sleeve areas and will even be edged into the gloves 34. There of course will be some slight leakage between the cuff 32 and cuff 34; however, this is not objectionable and in many cases will be desirable for air circulation purposes. The cuff 32 hence can be made of any suitable elasticized cloth so as to keep a relatively secure fit between the cuff and the glove of the wearer.

Figure 6:
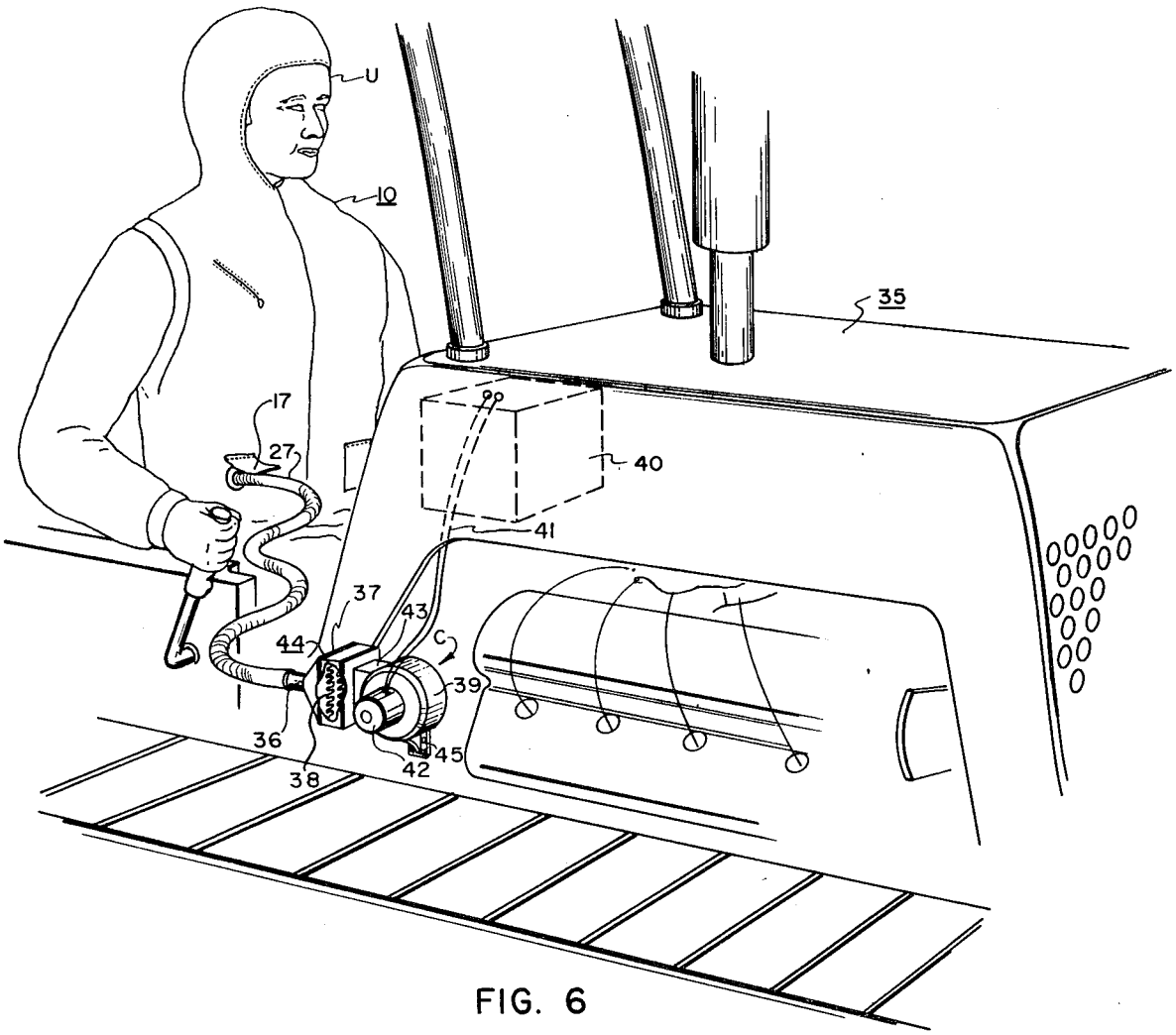
FIG. 6 is an enlarge perspective, illustrating a fan and electrical unit that can be powered by the battery of the vehicle to give heated air to and into the suit of the user.

FIG. 6 illustrates usage of the invention with a tractor 35 by way of example. The user U is wearing the garment 10, which of course may be replaced by jacket 10A in FIG. 3. In any event, in FIG. 6 the conduit is attached to the garment by the Velcro attachments as in FIGS. 1A and 7 and as heretofore explained, and conduit 27 is routed and connects to cylindrical stub 36 of heater 37. Heater 37 includes a serpentine electrical heating coil 38 which, with fan 39, is heated by energy supplied by battery 40. This is effective through cable 41, a two-conductor cable, leading to fan motor 42, with a shunt line 43 serving as a heating cable for the serpentine electrical heating coil 38. The unit including the heater 44 and fan 39 may be mounted to the tractor by bolts 45 or by other suitable attachments, brackets, and so forth.

In the event that a heating coil is not supplied the unit, the heat of the engine can be employed, picked up by the fan in the direction of arrow C in FIG. 6, and the heated air conveyed to the suit of the wearer or user U. Accordingly, heated air is supplied the user either by virtue of a heater 39, an electric heater powered by battery 40, or simply by warm air coming in the direction of arrow C in the fan to be pumped into conduit 27.

Conduit 27 is made of plastic, Neoprene or rubber, and in any event will be corrugated transversely so as to provide a measure of "flex" in such conduit or tubing.

Figure 7:
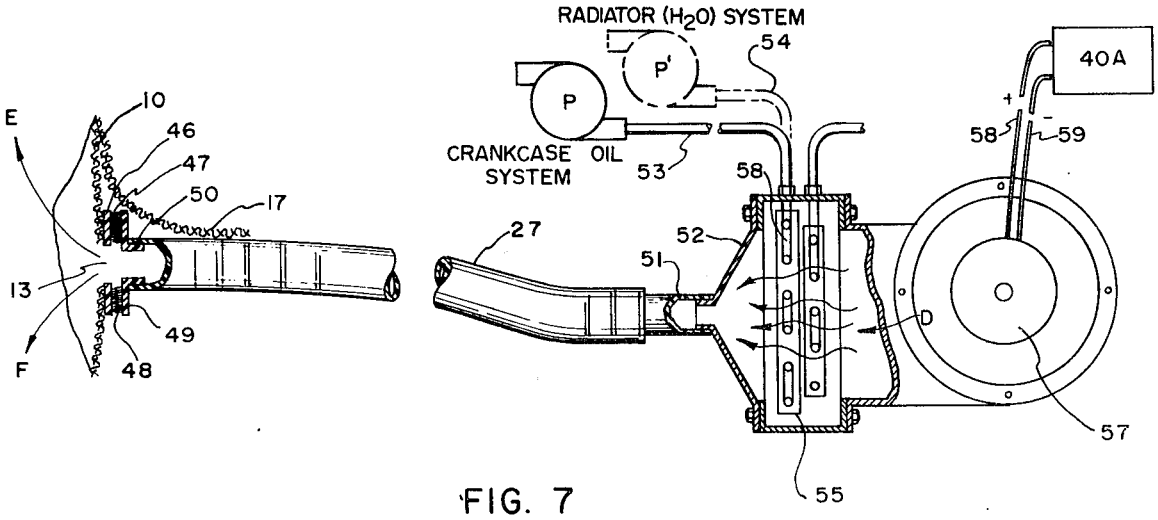
FIG. 7 illustrates the system of FIG. 6 can be adapted for use with the hot-water radiator system or engine oil system of the vehicle.

In FIG. 7 the suit 10 is shown with its righthand port 13 being provided with a solid ring 46 that is glued about the opening and provided with a Velcro layer 47.

Corresponding Velcro layer 48 is glued to the undersurface of flange 49, and the same receives the end 50 of conduit 27. The remaining end of the conduit is pushed over ports 51 of shroud 52 receiving the incoming air. FIG. 7 illustrates that either that the oil system 53 of the vehicle or the hot-water radiator system 54 may be employed, by inserting heating unit 55 in series with the oil or water circulatory system, as the case may be, including liquid pump P,P'. Thus, the fan only at 57 in FIG. 7 will be powered as by leads 58 and 59 leading to battery 40A in FIG. 7. The incoming cool air is thus urged by fan 57 in the direction of arrow D so as to pass between or across the interconnected conduit 58, which are connected in series with respect to each other and to pump P. Accordingly, either the warmed crank-case oil or the water from the radiator is circulated through these interconnecting heating tubes 58 so that a heat exchange may take place as between these tubes and in the incoming air at D. Such heated air is conducted in the direction toward port or opening 13 of suit 10 so that the now heated air will heat the body of the user as indicated by arrows E and F in FIG. 7.

Figure 8:
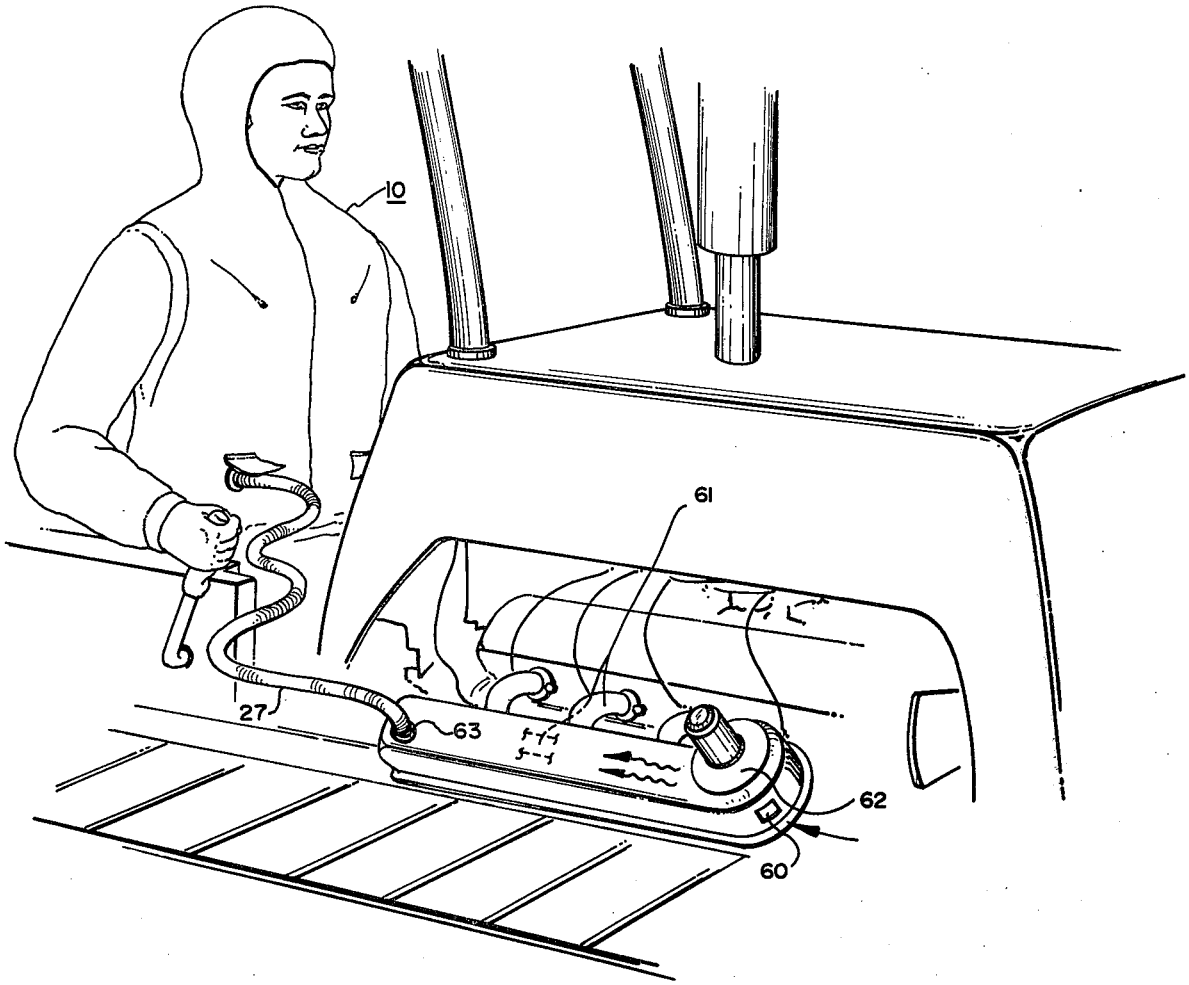
FIG. 8 illustrates providing a suit with heated air supplied by drawing air over the exhaust manifold of a vehicle.

In FIG. 8 a shroud 60 is disposed over the exhaust manifold 61 of the engine. Accordingly, the fan 62 draws air over the exhaust manifold and, when heated, urges this air along the shroud 60 to outlet 63. Such outlet may comprise a flange similar to flange 50 in FIG. 7. In any event, a flex conduit 27, connected to suit 10 in the manner shown in FIGS. 3 and 6, will receive the incoming warm air as provided by the engine itself and, specifically, for example, from the exhaust manifold thereof as to the heated air passing thereover.

Figure 9:
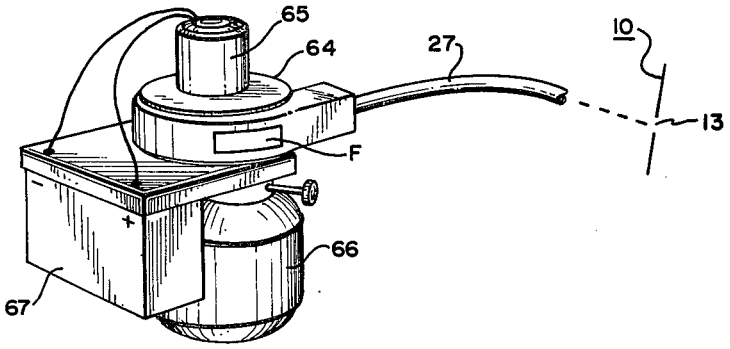
FIG. 9 shows a self-contained heater-fan unit for supplying warm air to a suit.

FIG. 9 illustrates the employment of a versatile unit 64 which consists of a fan 65, a butane or other LP heater 66 with a battery 67. The battery is provided to supply electrical energy to the fan 65. A centrifugal or other type of conventional air-circulating means may be provided for, and in lieu of the fan 65, such that heater 66 heats the air drawn in by the same and passes it rhough a connected conduit 27. Such conduit again will lead to port 13 or any other port of the garment. The heat exchange may take place by virtue of a heated plate, heated tubes, or other heat exchanger F in FIG. 9. The unit in FIG. 9 is especially suitable for fishermen and other persons working out of boats wherein a heat source is needed to supply forced heated air to the jacket or suit of a wearer. This is especially suitable for outdoorsmen such as hunters and fishermen, for use in lake sites, in duck blinds, and so forth.

What is provided, therefore, is an invention, consisting, in its parts, of a suit or jacket of essentially single layer variety having right, left and rear ports designed for suitable and convenient attachment to an air-conditioning hose or conduit. Also is the concept of providing heating means at a vehicle or other stationary site so as to warm the interior of the suit or jacket. Likewise, the suit or jacket is especially designed so that the hood thereof, where employed, can be heated at the head area and also at the elbow and knee areas, even at those these limbs are temporarily in a bent position.

While particular embodiments of the invention have been shown and described, it will be obvious to those skilled in the the art the various changes and modifications which may be made without departing from the essential features of the present invention and, therefore, the aim in the appended claims is to cover all such changes and modifications as fall within the true spirit and scope of the invention.

I claim:

1. An item of wearing apparel for receiving interiorly, from an external source, conditioned air, said item comprising a torso covering having front-left and front-right, flat, essentially non-protruding conduit connection means, a rear, flat, essentially non-protruding conduit connection means, and semi-releasable flat means releasably secured over and about respective ones of said conduit connection means, each of said conduit connection means comprising a solid flat ring provided with a face-layer of the VELCRO type.

2. The item of claim 1 wherein said torso covering has air-communicating flat ports circumscribed by said conduit connection means, respectively, said flat means comprising flaps respectively disposed over said ports and each having a corresponding ring-like adhesive cloth selectably releasably secured to and over said face-layer, respectively, whereby to releasably close said ports.

3. An item of wearing apparel having a transverse inlet for receiving externally supplied conditioned air, said item including a hood comprising an outer hood portion, formed integrally with and as a continuous part of said item, and also an interior head liner free at a lower portion thereof proximate the wearer's neck and operatively mutually spaced from said hood portion and communicating with the interior of said item, whereby to permit the passage of conditioned air upwardly between said hood portion and said head liner.

4. An air-conditioned wearing apparel item having a body provided with plural air-conditioning-connection, essentially-flat wall ports, flaps releasable secured to said body over respective ones of said wall ports, and plural sets of intercooperable means, including ring-shaped means having connection means of the VELCRO type thereon secured to said body about respective ones of said wall ports and cooperating connection means also of the VELCRO type secured to and inwardly of said flaps, for effecting a releasable closure between said flaps and body over said wall ports.

* * * * *